US005983677A

United States Patent [19]

Shibata

[11] Patent Number: 5,983,677

[45] Date of Patent: Nov. 16, 1999

[54] JACQUARD PATTERN CONTROL MECHANISM FOR A CIRCULAR KNITTING MACHINE

[75] Inventor: Takao Shibata, Osaka, Japan

[73] Assignee: Precision Fukuhara Works, Ltd., Kobe, Japan

[21] Appl. No.: 09/110,596

[22] Filed: Jul. 28, 1998

Related U.S. Application Data

[63] Continuation-in-part of application No. 09/052,577, Mar. 31, 1998, abandoned.

[51] Int. Cl.[6] ..... D04B 15/78

[52] U.S. Cl. ..... 66/219; 66/216

[58] Field of Search ..... 66/215, 216, 217, 66/218, 219, 220, 221

[56] References Cited

U.S. PATENT DOCUMENTS

| | | | |
|---|---|---|---|
| 4,715,198 | 12/1987 | Ploppa et al. | 66/219 |
| 5,046,333 | 9/1991 | Sawazaki et al. | 66/219 |
| 5,241,288 | 8/1993 | Aria | 66/219 |
| 5,375,436 | 12/1994 | Fucik . | |
| 5,775,135 | 7/1998 | Shibata et al. | 66/219 |

FOREIGN PATENT DOCUMENTS

| | | | |
|---|---|---|---|
| 0 249 203 | 6/1987 | European Pat. Off. . | |
| 487152 | 5/1992 | European Pat. Off. | 66/219 |
| 0629727A1 | 6/1994 | European Pat. Off. . | |
| 1368366 | 7/1963 | France . | |
| 2318377 | 10/1974 | Germany | 66/219 |
| 62-299554 | 12/1987 | Japan . | |

*Primary Examiner*—John J. Calvert
*Assistant Examiner*—Larry D. Worrell, Jr.
*Attorney, Agent, or Firm*—Alston & Bird LLP

[57] ABSTRACT

A jacquard pattern control mechanism for a circular knitting machine is provided in which a plurality of rocker bar supporting members are each slidable in one of the grooves along which one of the knitting elements move, a plurality of elongate rocker bars are pivotally mounted on one of unsaid plurality of rocker bar supporting members for movement about a medial pivot, the opposite end portions of the rocker bars being selectively movable between operative and inoperative positions and having magnetically attractable sections thereon, magnet attracting devices are operatively associated with the opposite end portions of the elongate rocker bars for selectively attracting one of the magnetically attractable sections at opposite ends of the rocker bars to pivot the rocker bars and selectively move one of the opposite end portions thereof to the other operative position and the other opposite end portion thereof to the inoperative position, the magnetic attracting devices comprising a permanent magnet and a pair of electromagnets disposed on opposite sides of the permanent magnet and connected in series, the permanent magnet having an extension extending outwardly towards the rocker bars and having a pair of wing portions extending outwardly from the center portion of the extension, generally parallel to the rocker bar supporting members and having outer sections disposed in attractable relation to the magnetically attractable sections at opposite ends of the rocker bars.

13 Claims, 11 Drawing Sheets

JACQUARD PATTERN CONTROL MECHANISM FOR A CIRCULAR KNITTING MACHINE

RELATED APPLICATION

This application is a continuation-in-part of the commonly owned application Ser. No. 09/052,577, filed Mar. 31, 1998 now abandoned and entitled: "Jacquard Pattern Control Mechanism For A Circular Knitting Machine."

FIELD OF THE INVENTION

The present invention relates to circular knitting machines and more particularly to a jacquard pattern control mechanism therefor.

BACKGROUND OF THE INVENTION

Jacquard knitting on a circular knitting machine requires needle selection of specific knitting needles being switched between active and inactive positions. Such needle selection is typically provided by jacquard pattern control mechanisms which include pattern selection devices. Such jacquard control mechanisms, including their pattern selection devices, are discussed in co-pending United States patent application, Ser. No. 771,519, now U.S. Pa. No. 5,689,977, commonly owned with this application and incorporated herein by reference.

As is stated in U.S. Pat. No. 5,689,977, prior pattern selection devices combining a permanent magnet and an electromagnet required a plurality of control electromagnets in order to function properly. In addition, such devices were required to limit the size of the electromagnets such that the magnetic attraction generated thereby would not be stronger than that of the permanent magnet. Therefore, both the permanent magnet and the electromagnets had to be quite large which caused spatial problems in the knitting machines.

Applicant solved many of these problems and deficiencies in U.S. Pat. No. 5,689,977 by pattern selection devices embodying both a permanent magnet and an electromagnet working in concert to provide the necessary magnetic attraction while using small magnets. The present invention is an improvement on the invention of U.S. Pat. No. 5,689,977.

SUMMARY OF THE INVENTION

It is an object of the present invention to provide a jacquard control mechanism for a circular knitting machine that provides an improved electromagnetic pattern selection device producing even stronger magnetic attraction than has been achieved heretofore by comparable sized magnets.

This object is accomplished by an electromagnetic selecting mechanism including a rocker bar having first and second attractable portions at its opposite ends and magnetic attracting means comprising a permanent magnet and first and second electromagnets connected to opposite sides of the permanent magnet in series. The electromagnets include first and second cores and first and second coils, with the cores having one end thereof disposed in attracting relation to a portion of the first and second attractable portions of the rocker bar. The permanent magnet includes a center tip extending therefrom into juxtaposed relation to the medial portion of the rocker bar and having a pair of wings extending outwardly therefrom toward the ends of the cores and into juxtaposed relation to portions of the first and second attractable portions of the rocker bar.

BRIEF DESCRIPTION OF THE DRAWINGS

Some of the objects and advantages of the present invention having been stated, others will appear as the description proceeds when considered in conjunction with the accompanying schematic drawings in which.

DETAILED DESCRIPTION OF THE PREFERRED EMBODIMENTS

Figure 1:
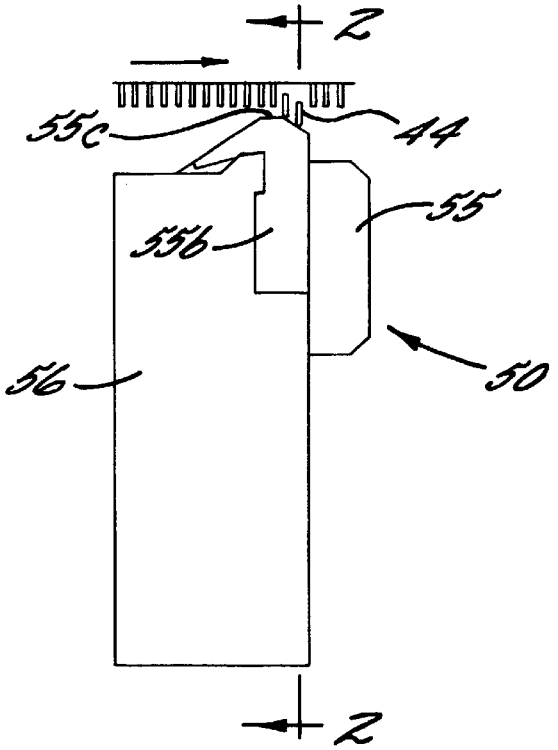
FIG. 1 is a fragmentary schematic view of the electromagnetic selecting mechanism of the present invention.

Referring now more specifically to the drawings and particularly to FIGS. 7–14, there is illustrated schematically and sectionally the core part of a circular knitting machine, generally indicated at 20, which incorporates the jacquard pattern control mechanism of the present invention. Circular knitting machine 20 includes a rotary cylinder 21 having a multiplicity of grooves (not shown) therein. A knitting needle 22 is mounted for vertical sliding movement in each of the grooves in the needle cylinder 21.

Circular knitting machine 20 further includes a cam block 23 mounted adjacent the periphery of the needle cylinder 21. Cam block 23 mounts a needle cam (not shown) for raising and lowering the needles 22 between an active (knitting) position and an inactive (welting) position.

A rotary sinker cap or dial 25 is mounted on top of the needle cylinder 21 and has a multiplicity of grooves 26 extending radially from the outer periphery to the inner periphery thereof. A sinker 27 is slidably mounted in each of the sinker grooves 26 for movement between an active (extended) position and an inactive (retracted) position. A sinker cam block 30 is mounted above the sinker cap 25 and mounts on its lower surface and inner sinker cam 31 and an outer sinker cam 32 in facing relation to the grooves 26 and sinker cap 25.

Sinker 27 has a main section 27*a* and an extension section 27*b*. The outer end of the main section 27*a* defines a vertical edge 27*c*. A butt 27*d* protrudes upwardly from extension section 27*b* and has vertical edges 27*e* and 27*f*. The main section 27*a* has a nose 27*g* defining a first top edge 27*h* for forming pile loops from a pile yarn PY. Main section 27*a* has a second top edge 27*i* for forming ground or nonpile stitch loops from a ground yarn GY. Pile yarn PY and ground yarn GY are fed to the needles 22 by a yarn carrier 28 (FIGS. 7–12).

Cam 31 has a side edge 31*a* that engages the vertical edge 27*c* of sinker 27 and a side edge 31*b* which cooperates with a side edge 32*a* on cam 32 to define a cam track 33 which receives the butt 27*d* and controls sinker 27 by engagement of side edge 31*b* with vertical edge 27*e* and side edge 32*a* with vertical edge 27*f*. Cam 32 has another side edge 32*b*, the function of which will be described presently.

Figure 7:
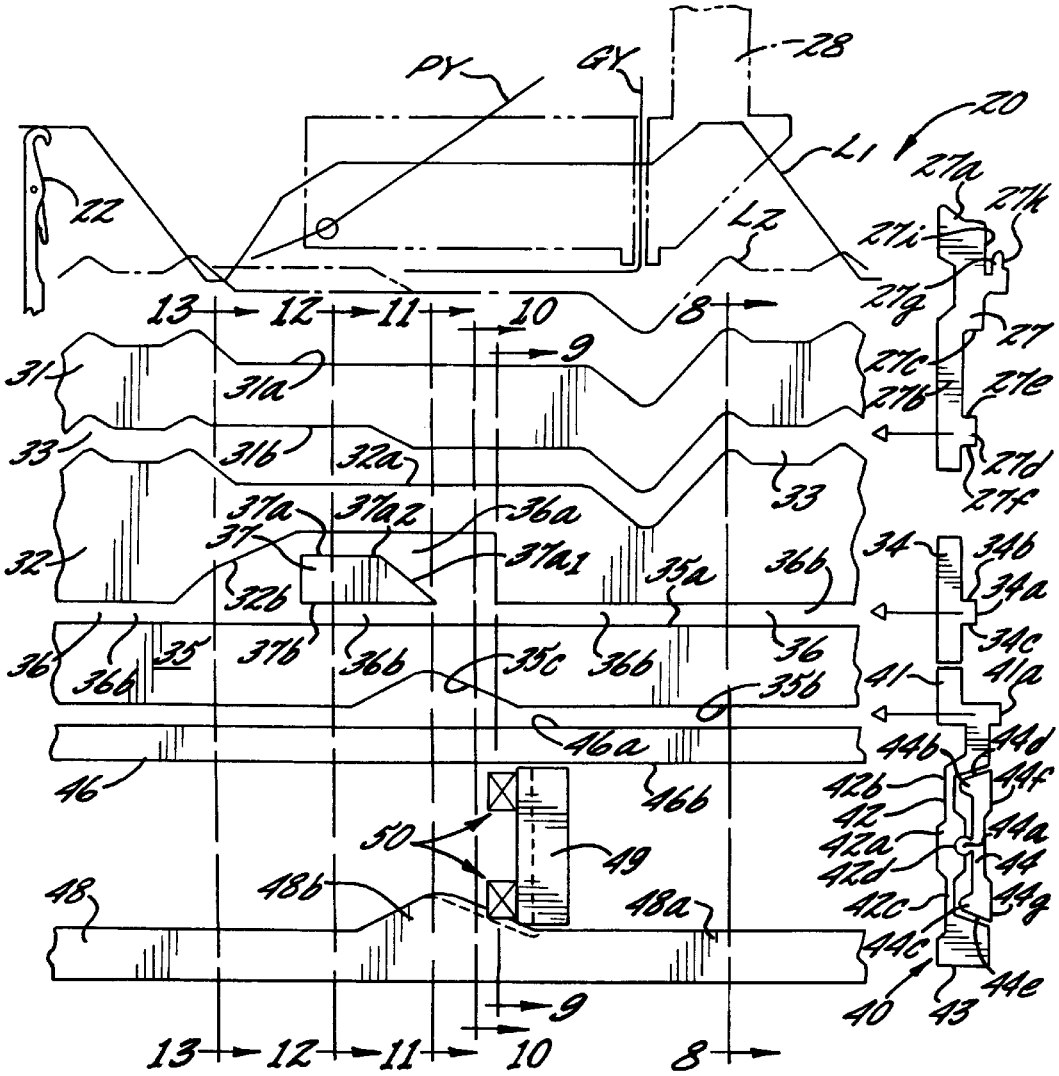
FIG. 7 is a fragmentary, schematic view of cams, needle, sinker and operating elements of a jacquard control mechanism of the present invention.
Figure 8:
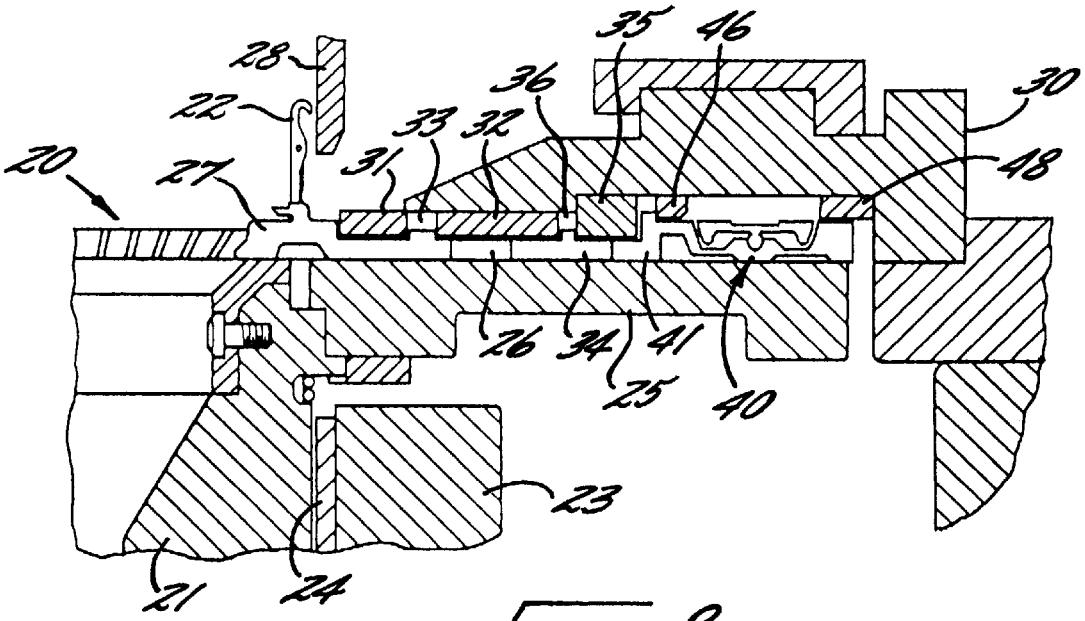
FIG. 8 is a fragmentary vertical sectional view taken substantially along line 8—8 in FIG. 7.
Figure 9:
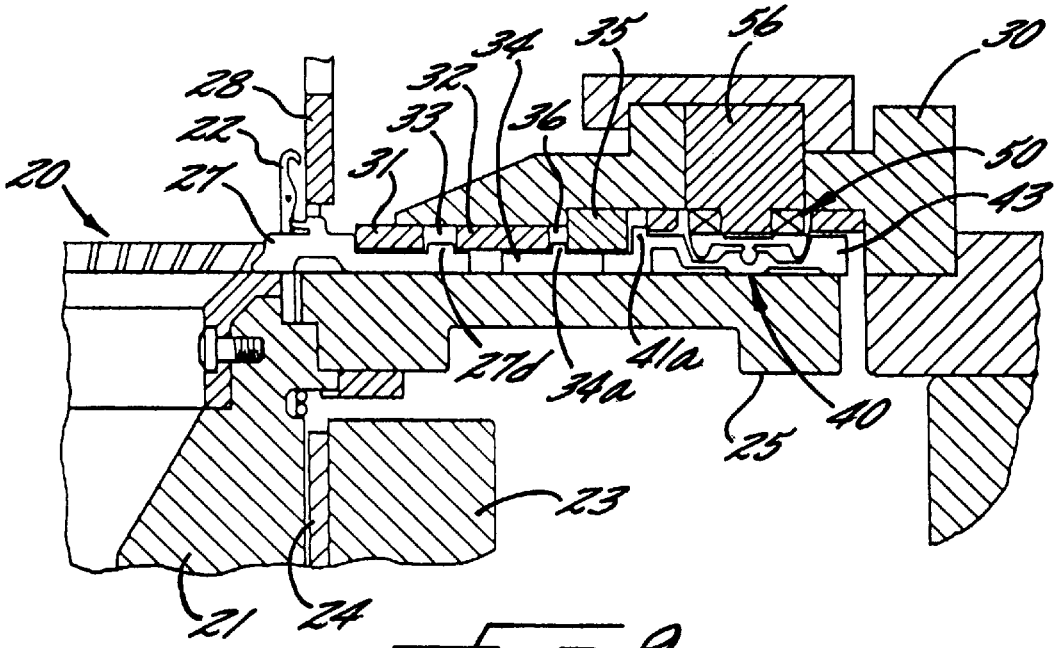
FIG. 9 is a fragmentary vertical sectional view taken substantially along line 9—9 in FIG. 7.
Figure 10A:
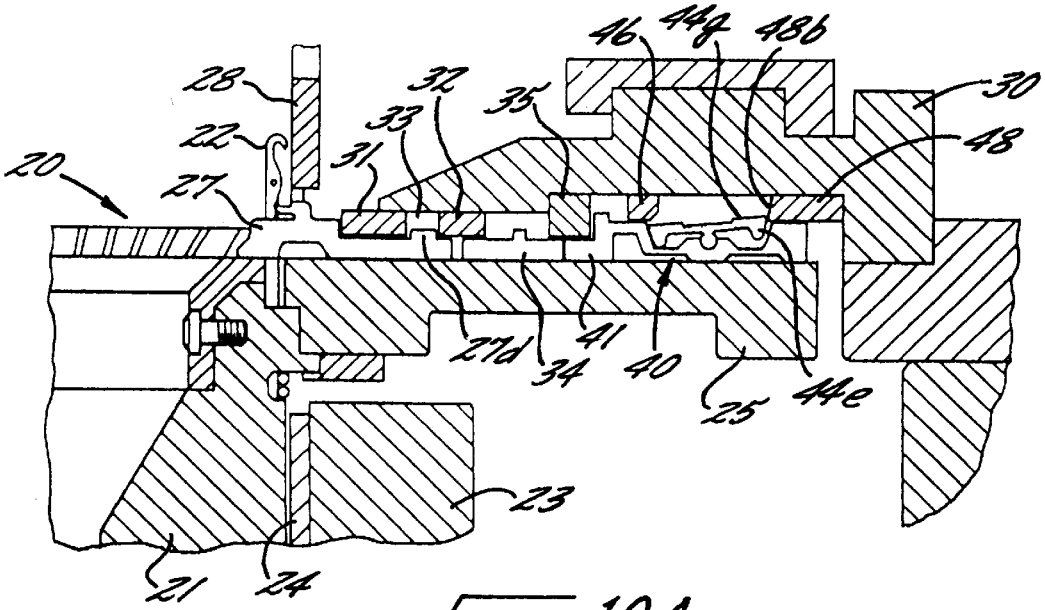
FIG. 10A is a fragmentary vertical sectional view taken substantially along line 10—10 in FIG. 7 with the sinker in its pile forming operational position.
Figure 10B:
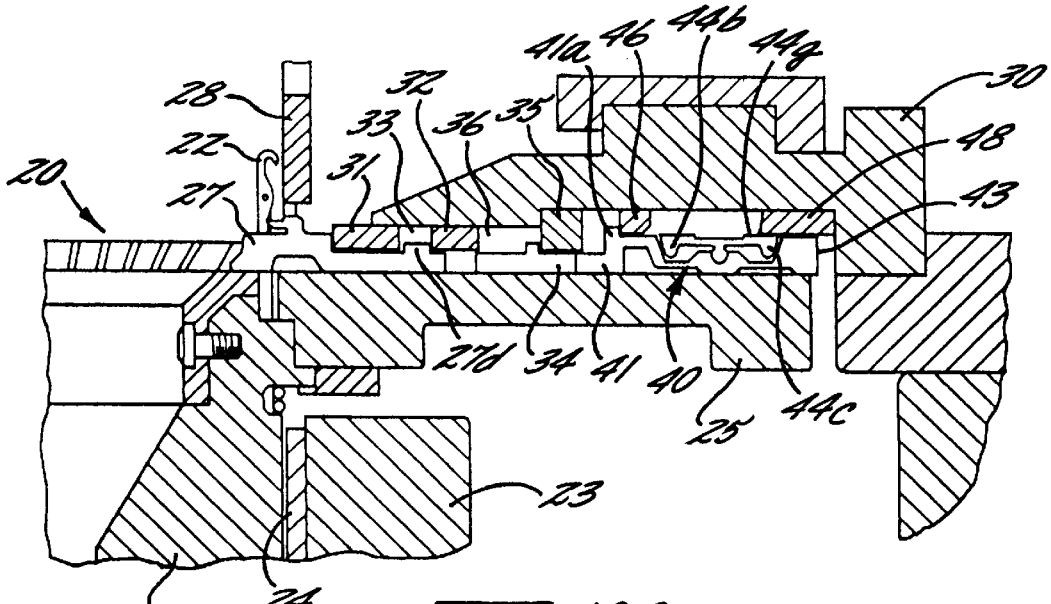
FIG. 10B is a view similar to FIG. 10A with the sinker in its non-pile forming operational position.
Figure 11A:
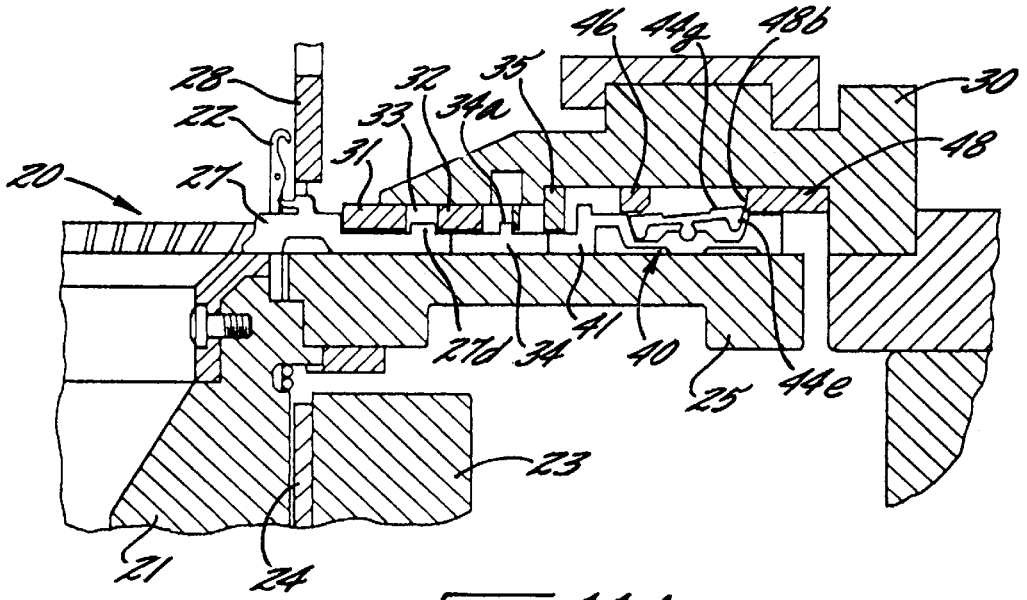
FIG. 11A is a fragmentary vertical section taken substantially along line 11—11 in FIG. 7 with the sinker in its pile forming position.
Figure 11B:
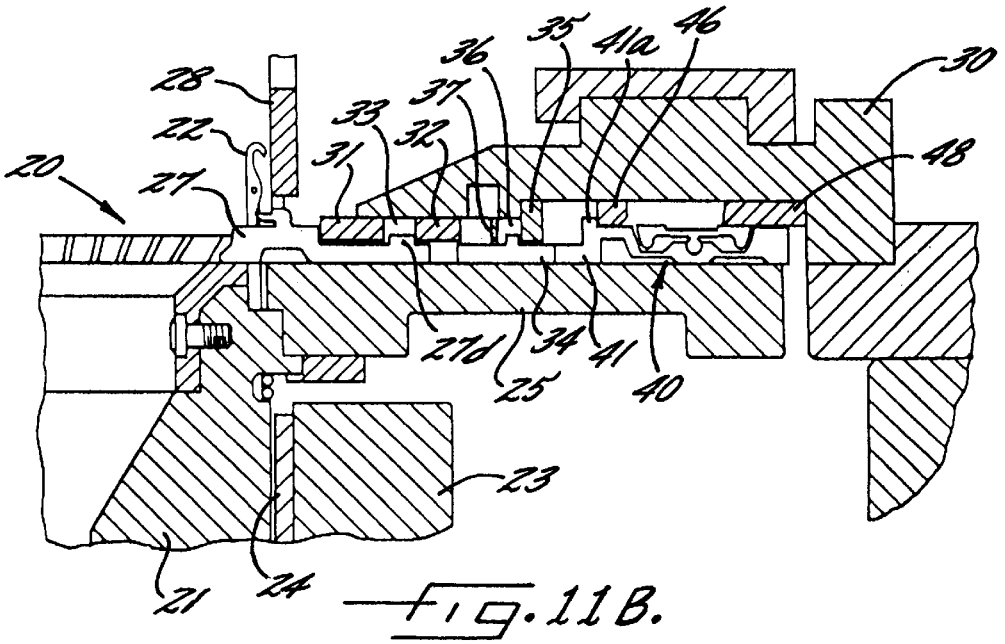
FIG. 11B is a view similar to FIG. 11A with the sinker in its non-pile forming position.

An intermediate member 34 is disposed in each sinker groove in sinker cap 25 outwardly of sinker 27 (FIGS. 8–13). Intermediate member 34 has a butt 34*a* thereon which has a first vertical edge 34*b* and a second vertical edge 34*c* (FIG. 7). A first intermediate cam 35 is mounted on cam block 30 adjacent cam 32 and has a first side edge 35*a* which cooperates with side edge 32*b* of cam 32 to define a cam track 36. Cam track 36 receives butt 34*a* on intermediate member 34 and controls and moves intermediate member 34 by engagement with side edge 32*b* with vertical edge 34*b* and side edge 35*a* with vertical edge 34*c* (FIG. 7). A second intermediate cam 37 is disposed in cam track 36 and has a first side edge 37*a* and a second side edge 37*b*. Side edge 37*a* has a first slope or angled section $37a_1$ and a second straight section $37a_2$. Side edge 37*b* of cam 37 is straight and parallel to side edge 35*a* of cam 35. Cam 37 divides cam track 36 into two branches 36*a* and 36*b*. If butt 34*a* on intermediate member 34 is caused to follow branch 36*a* of cam track 36, side edge 37*a* of cam 37 engages vertical edge 34*c* of butt 34*a* and moves intermediate member 34 into contact with sinker 27 and moves sinker 27 further toward the needles 22. Such movement brings the nose 27*g* of sinker 27 into operative position to form pile loops over top edge 27*h*. Thereafter, side edge 32*b* returns intermediate member 34 back to its retracted position which corresponds to branch 36*b* of cam track 36.

Figure 12A:
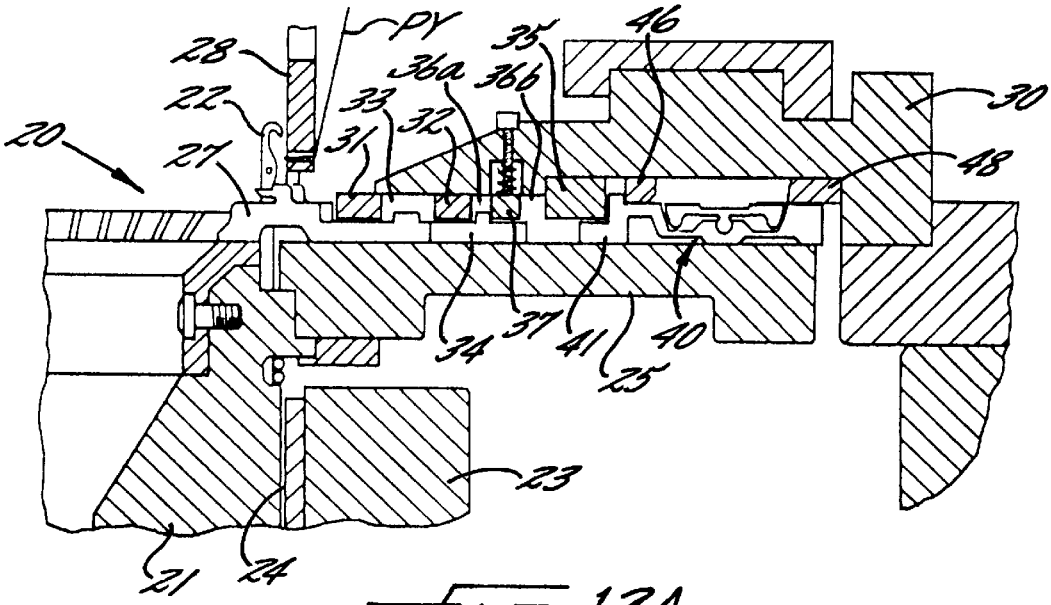
FIG. 12A is a fragmentary, vertical sectional view taken substantially along line 12—12 in FIG. 7 with the sinker in its pile forming position.
Figure 12B:
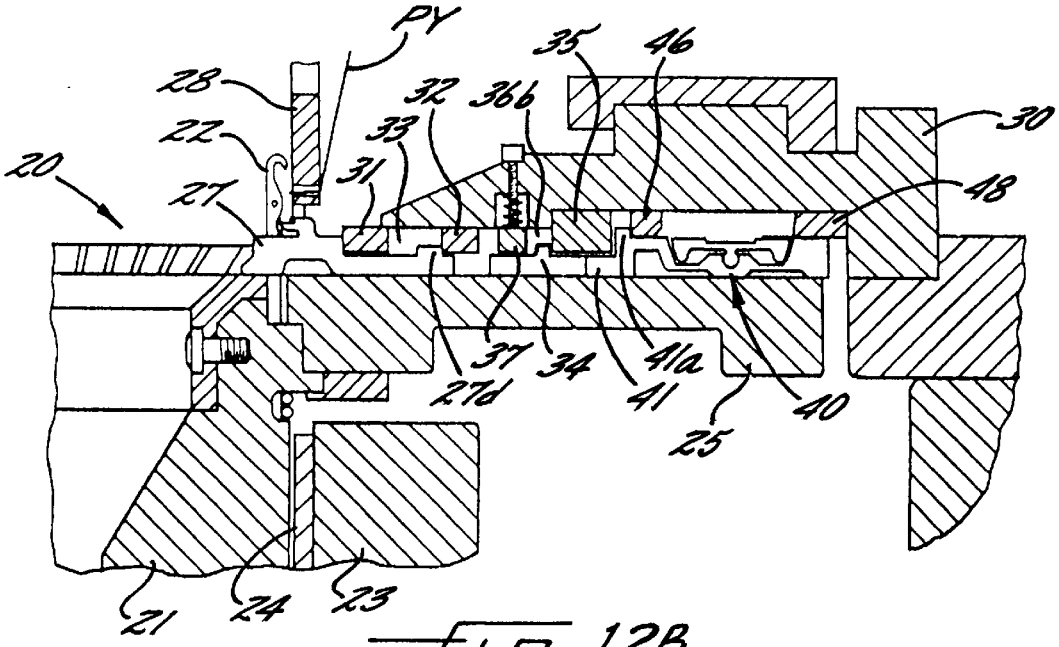
FIG. 12B is a view similar to FIG. 12A with the sinker in its non-pile forming position.
Figure 13:
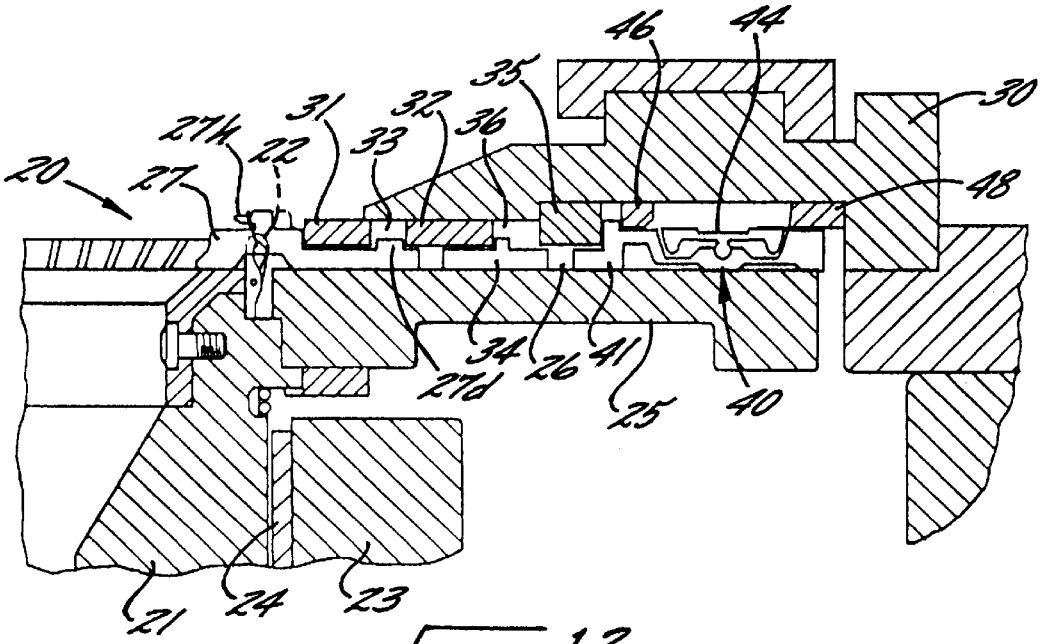
FIG. 13 ia a fragmentary, vertical sectional view taken substantially along line 13—13 in FIG. 7.

The second intermediate cam 37 is preferably mounted on cam block 30 for movement between an extended, operative position and a retracted, inoperative position (FIGS. 12A and 12B). Accordingly, cam block 30 is provided with a recess 30*a* into which an inner end 38*a* of a threaded operating member 38 extends. Cam 37 is mounted on the inner end 38*a* of operating member 38 by receiving this inner end 38*a* in a cavity 37*c* in cam 37. Cavity 37*c* is larger than the inner end 38*a* of operating member 38 such that cam 37 may move a predetermined amount longitudinally or axially of operating member 38. A coil spring 39 is positioned around operating member 38 between cam 37 and the bottom of recess 38*a* to bias cam 37 toward the inner end of operating member 38 and toward its operative position. Thus, cam 37 protects the butt 34*a* from damage from outside forces which may act thereon.

A rocker bar supporting member 40 (FIGS. 7–14) is slidably mounted in each sinker groove 26 outwardly of intermediate member 34. Rocker bar supporting member 40 includes an inner end section 41, the lower portion of which is received in sinker groove 26 and the upper portion of which includes a butt 41*a*. Butt 41*a* includes a first vertical edge 41*b* and a second vertical edge 41*c*.

Rocker bar supporting member 40 includes a medial section 42 having a central portion 42*a* and opposite end portions 42*b* and 42*c*. The lower portion of central portion 42*a* is received in sinker groove 26 and the upper portion of which has a recess or socket 42*d* therein. Opposite end portions 42*b* and 42*c* of medial section 42 are of less height than central portion 42*a* such that the top edges thereof are recessed below the top edge of the central portion 42*a*. Finally, rocker bar supporting member 40 includes an outer end section 43, the lower portion of which is received in sinker groove 26.

A rocker bar 44 is mounted on the medial section 42 of rocker bar supporting member 40 for pivotal movement by a circular pivot protrusion 44*a* which is received in socket 42*d*. Rocker bar 44 has symmetrical opposite end portions 44*b* and 44*c* which are beveled, wedge-shaped at their outer extremities at 44*d* and 44*e*. The lower portions of opposite end portions 44*b* and 44*c* are bulbous-shaped and serve to engage the upper ends of end portions 42*b* and 42*c* of medial section 42 of rocker bar supporting member 40 to limit the pivotal movement of rocker bar 44. The upper sections 44*f* and 44*g* of end portions 42*b* and 42*c* are magnetically attractable and are raised above the central portion of rocker bar 44.

A rocker bar supporting member cam 46 is carried by cam block 30 adjacent cam 35. Cam 46 has a side edge 46*a* which is straight and spaced from a second side edge 35*b* of cam 35 to define therewith a cam track 47 which receives and controls butt 41*a* on rocker bar supporting member 40. Cam 35 has a concave section 35*c* in its second side edge 35*b* corresponding to the location of second intermediate cam 37.

Cam 46 has a second side edge 46*b* which is positioned to engage wedge-shaped end 44*d* of rocker bar 44 when rocker bar 44 is pivoted to have end portion 44*b* extended to maintain the rocker bar 44 and rocker bar supporting member 40 in the inactive, retracted position. A rocker bar actuating cam 48 is mounted on cam block 30 and has a side edge 48*a* spaced from side edge 46*b* a distance equal to the length of rocker bar 44. Side edge 48*a* engages the wedge-shaped end 44*e* when rocker bar 44 is pivoted to position end portion 44*c* in extended position. Cam 48 has a protruding portion 48*b* in side edge 48*a* in alignment with and of the same shape as the concave section 35*c* in side edge 35*b* of cam 35. The protruding portion 48*b* preferably has a trapezial-shaped cross section corresponding to the wedge-shaped end 44*e* of rocker bar 44.

Upstream of protruding portion 48*b* of cam 48, a cancelling cam 49 is positioned above the path of travel of rocker bar 44 and includes an upperly and outwardly sloped surface 49*a* to engage a pivoted or tilted rocker bar 44 and cam rocker bar 44 back to a level or neutral position. Cancelling cam 49 will function irrespective of the direction in which rocker bar 44 is pivoted. Preferably, cancelling cam 49 is constructed of an antimagnetic material so that it effectively weakens leaking magnetic attraction from the permanent magnet.

A magnetic attraction selection device, generally indicated at 50, is positioned immediately downstream of cancelling cam 49 and above the path of travel of rocker bar 44 such that the rocker bar 44 on the rocker bar supporting member 40 passes closely therebeneath. Selection device 50 is positioned upstream of protruding portion 48*b* of cam 48.

Figure 2:
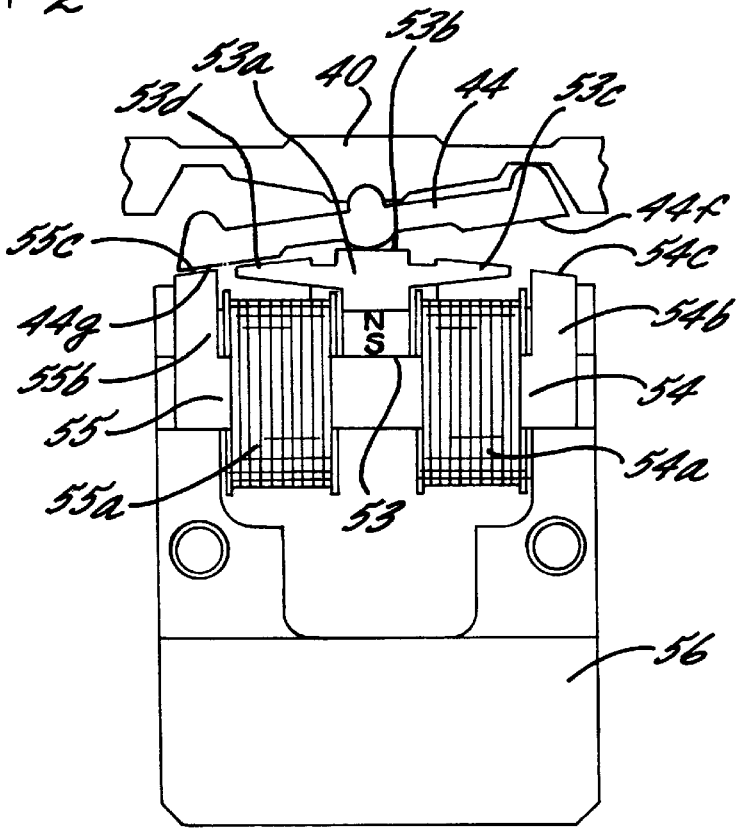
FIG. 2 is a side elevation of the mechanism shown in FIG. 1 taken substantially along line 2—2 in FIG. 1.

Selection device 50 includes two magnetic attraction means 51 and 52 (FIGS. 2, 7 and 14) disposed in position to attract magnetically the magnetic attractable section 44*f* and 44*g*, respectively, of rocker bar 44 when rocker bar 44 passes therebeneath (FIGS. 1, 2, 3 and 4 are shown with the elements upside down). Preferably, magnetic attraction selection device 50 comprises a permanent magnet 53 in the center and first and second electromagnets 54 and 55 on opposite sides thereof, which define the magnetic attraction means 51 and 52. Permanent magnet 53 and electromagnets 54 and 55 are all supported by a support member 56 (FIG. 2). Preferably, the permanent magnet 53 has an extension 53*a* which extends toward rocker bar 44 and has a central section 53*b* which engages the medial portion of rocker bar 44 to stabilize the same. Extension 53*a* also has two wing portions 53*c* and 53*d* extending generally parallel to rocker bar support member 40 and into overlying relation to portions of the magnetic tractable sections 44*f* and 44*g*, respectively, of rocker bar 44 when rocker bar 44 is passing therebeneath.

The extension 53*a* must be of a magnetic material and may be part of the permanent magnet 53 and, therefore, will be of permanent magnetic material. The wings 53*c* and 53*d* are tapered or beveled outwardly and upwardly from the center section 53*b* to the outer ends such that when rocker bar 44 is pivoted the lower surfaces of the wings 53*c* and 53*d* will be parallel to the magnetic attractable sections 44*f* and 44*g* and spaced therefrom a gap distance of between about 0.5 mm and about 2.0 mm.

Figure 3:
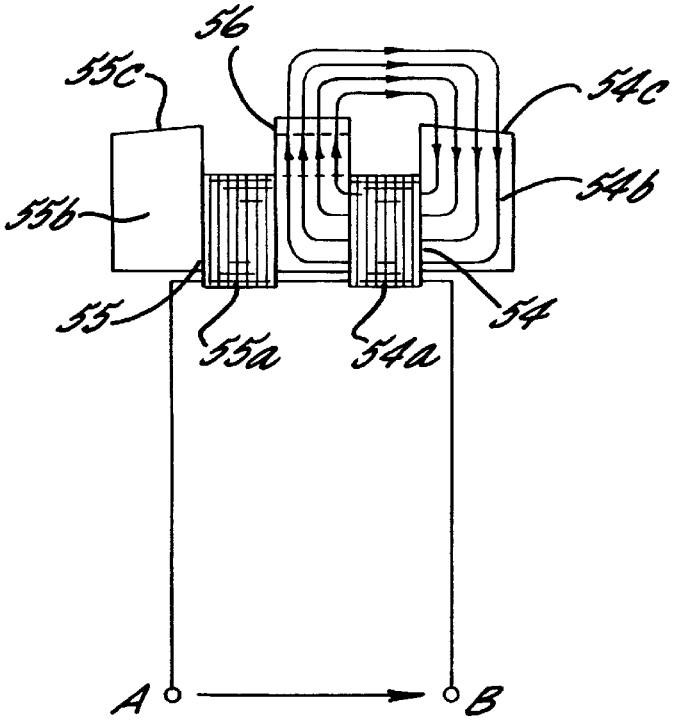
FIG. 3 is a schematic view of the mechanism of FIG. 2 and illustrating the lines of magnetic force generated when a positive voltage is applied thereto.

Electromagnets 54 and 55 include first and second exciting coils 54*a*, 55*a* on opposite sides of permanent magnet 53 and first and second cores 54*b*, 55*b* inside and extending to the left and right, respectively, of the coils 54*a*, 55*a*. The outer tips 54*c*, 55*c* of the cores 54*b*, 55*b* are slanted upwardly and outwardly from the inside to the outside to accommodate sufficient pivotal movement of rocker bar 44 without contact with these tips 54*c*, 55*c*. Also preferably, the magnetically attractable sections 44*f* and 44*g* of rocker bar 44 slant downwardly and outwardly for this same reason, with the same gap distance as stated above. The coils 54*a*, 55*a* are connected in series (FIGS. 3 and 4).

By applying positive or negative voltage to the electromagnets 54, 55, the tips 54*c*, 55*c* selectively attract magnetically attractable sections 44*f*, 44*g* of rocker bar 44. For example, when positive voltage is applied from A to B (FIG. 3), the magnetic field of the permanent magnet 53 is shut off by a flux generated by the first electromagnet 54 and this shut off first magnetic field and a flux generated by the second electromagnet 55 are added to the magnetic flux of the first electromagnet 54 creating a stronger magnetic field. At this time, the core 54*b* of the first electromagnet 54 selectively attracts the attractable section 44*f* of the rocker bar 44.

Figure 4:
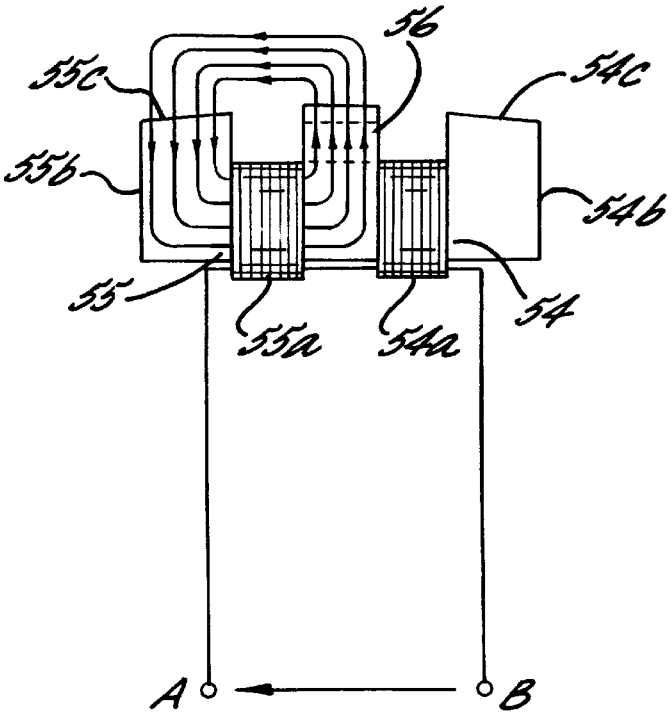
FIG. 4 is a schematic view similar to FIG. 3 illustrating the lines of magnetic force generated when a negative voltage is applied thereto.

As shown in FIG. 4, when a negative voltage is applied from B to A, the magnetic field of the permanent magnet 53 is shut-off by the flux generated by the second electromagnet 55 and the shut-off magnetic field from the permanent magnet 53 and the flux generated by the first electromagnet 54 are added to the first magnetic flux of the second electromagnet 55, creating a stronger magnetic field. At this time, the core 55*b* of the second electromagnet 55 selectively attracts the attractable section 44*g* of the rocker bar 44.

Figure 5:
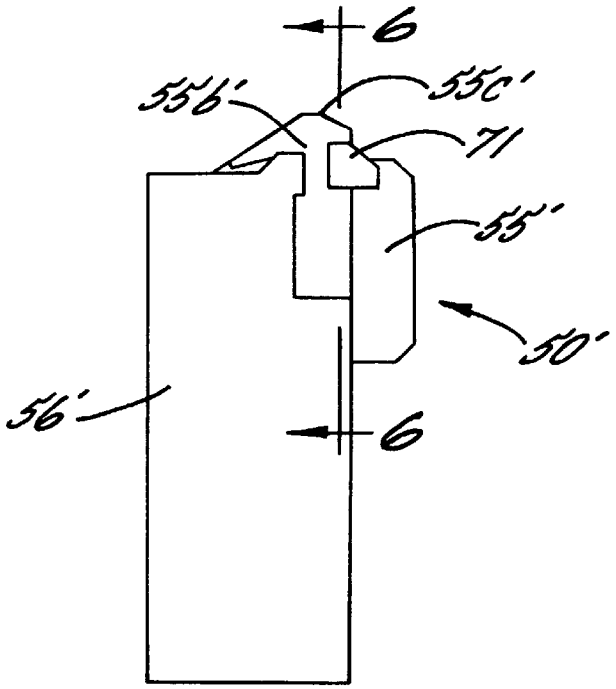
FIG. 5 is a view similar to FIG. 1 of another embodiment of the electromagnetic selecting mechanism of the present invention.
Figure 6:
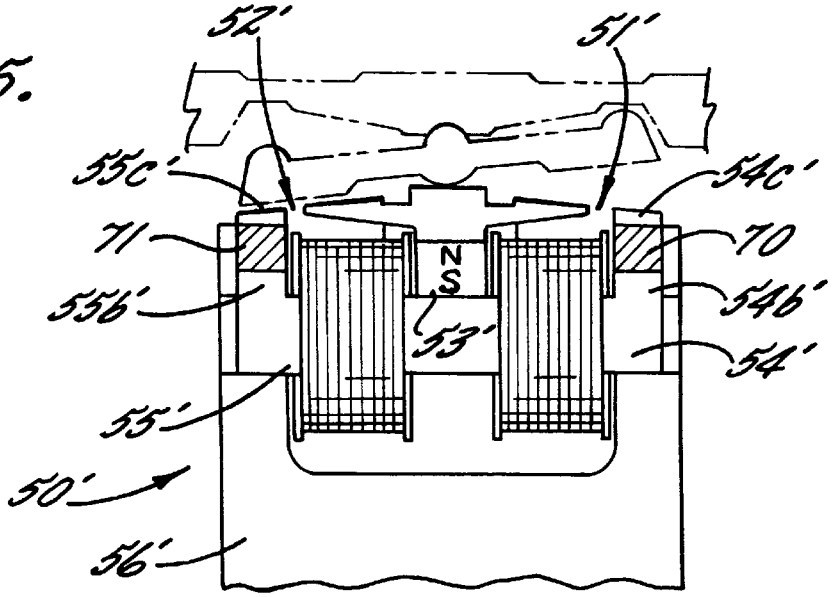
FIG. 6 is a fragmentary, vertical sectional view taken substantially along line 6—6 in FIG. 5.

Referring now to FIGS. 5 and 6, another embodiment of the electromagnetic selection device 50' of the present invention is illustrated and in which like parts are referred to by like reference characters with the prime notation added. The electromagnetic selection device 50' includes two magnetic attraction means 51' and 52' disposed in position to attract magnetically the magnetic attractable sections 44*f* and 44*g* respectively of rocket bar 44 when rocket bar 44 passes therebeneath. Preferably, magnetic attraction selection device 50' comprises a first permanent magnet 53' in the center and first and second electromagnets 54' and 55' on opposite sides thereof, which define the magnetic attraction means 51' and 52'. Permanent magnet 53' and electromagnets 54' and 55' are identical to the permanent magnet 53 and electromagnets 54 and 55 described above and will, therefore, not be described again.

Electromagnets 54' and 55' include first and second cores 54*b*' and 55*b*'. Cores 54*b*' and 55*b*' include second and third permanent magnets 70, 71. By providing the second and third permanent magnets 70, 71 underneath the tips 54*c*' and 55*c*', even when the next signal for attraction of the rocket bar 44 is sent to the electromagnets 54', 55', the second and third permanent magnets 70, 71 continue attracting the attractable sections 44*f* and 44*g* of the rocker bar 44. As a result, when the electromagnetic selection device is used in a circular knitting machine, after a needle selection has been performed, the electromagnetic selection device will receive no influence of the next needle selection signal. Therefore, there will be much less needle selection errors even at high speed operation.

Figure 16:
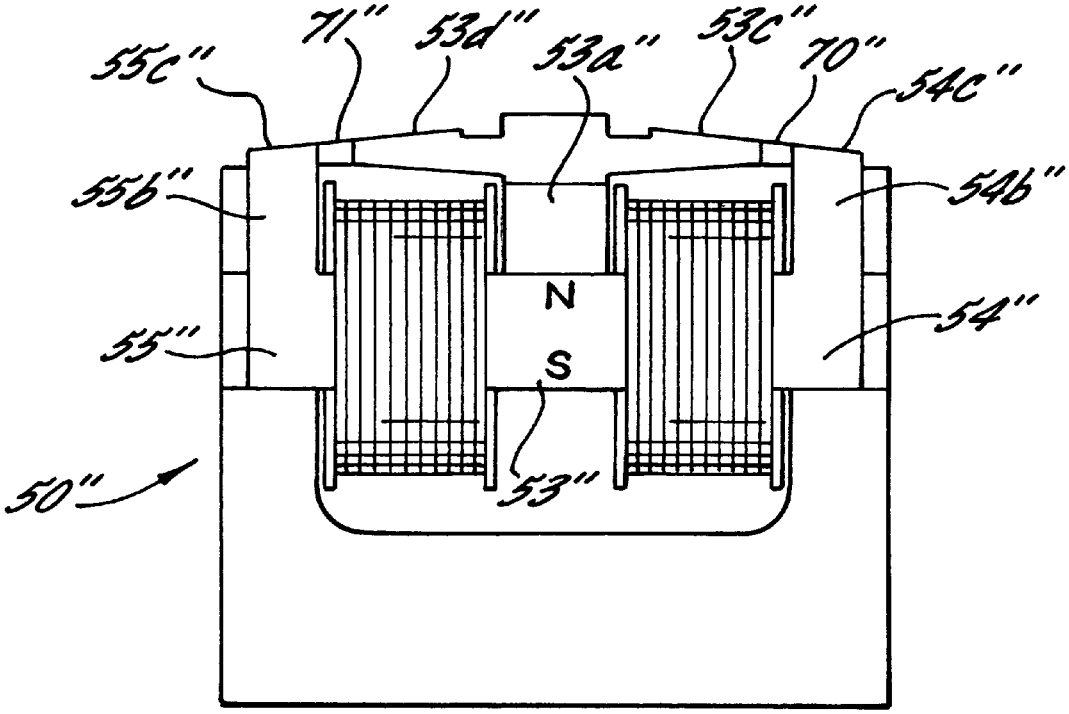
FIG. 16 is a view similar to FIG. 2 with portions removed for clarity of a further embodiment of the electromagnetic selecting mechanism of the present invention.
Figure 17:
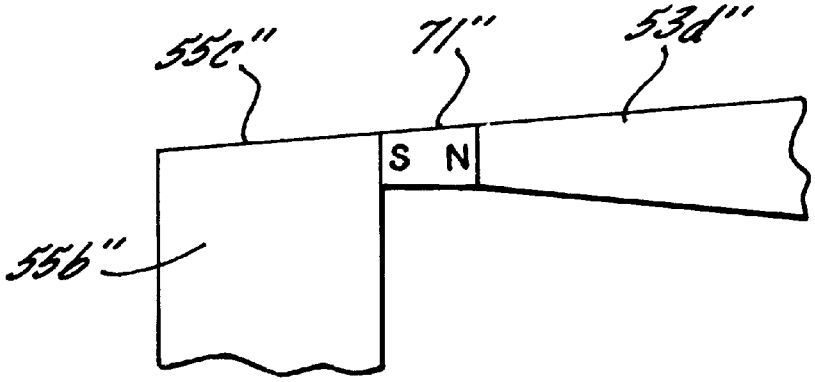
FIG. 17 is an enlarged, fragmentary detail of the upper left-hand portion of FIG. 16.

Referring now to FIGS. 16 and 17, a still further embodiment of the present invention is illustrated and like reference characters with the double prime notations are used with respect to like elements. An electromagnetic selection device 50" includes two magnetic attraction means 51" and 52" disposed in position to attract magnetically the magnetic attractable sections 44*f* and 44*g* respectively of rocker bar 44 when rocker bar 44 passes therebeneath. Preferably, magnetic attraction selection device 50" comprises a first permanent magnet 53" in the center and first and second electromagnets 54" and 55" on opposite sides thereof, which define the magnetic attraction means 51" and 52". Permanent magnet 53" and electromagnets 54" and 55" are identical to permanent magnet 53 and electromagnets 54 and 55 described above and will, therefore, not be described again.

Permanent magnet 53" has an extension 53*a*" with wing portions 53*c*" and 53*d*". Electromagnets 54" and 55" include first and second cores 54*b*" and 55*b*" with upper tips 54*c*" and 55*c*".

In this embodiment, second and third permanent magnets 70" and 71" are mounted between the outer ends of the wings 53*c*", 53*d*" and the upper tips 54*c*", 55*c*". Preferably, the configuration of the extension 53*a*" of first permanent magnet 53", second and third permanent magnets 70", 71" and the outer tips 54*c*", 55*c*" is such that the upper surfaces thereof are in a straight line.

The second and third permanent magnets 70" and 71" are mounted and held in place by any suitable means, such as an adhesive. Also, the poles of the second and third permanent magnets 70" and 71" are symmetrical.

With this arrangement, increased magnetic fields are achieved. For example, the magnetic field generated by the embodiment of this invention illustrated in FIG. 2 has a strength at the needle selection point of 1200 gauss, while the strength of the magnetic field generated by this embodiment is 1600 gauss at that point.

Figure 14:
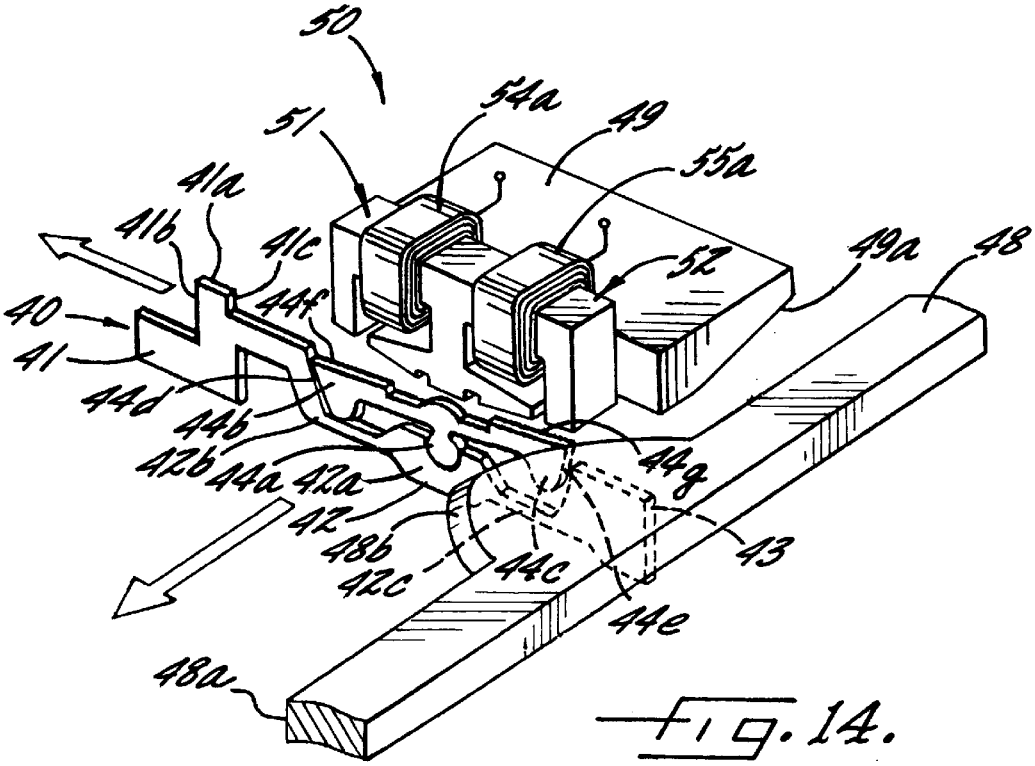
FIG. 14 is an enlarged, fragmentary perspective view of the rocker bar supporting member, rocker bar, rocker bar cam and electromagnetic selection mechanism of the present invention.

The operation of the various embodiments will now be described. When sinker 27 is to be advanced, a signal from a controller (not shown) is sent to the magnetic selection device 50, 50' or 50" to cause electromagnetic electromagnet 55 to attract magnetically attractable section 44*g* of rocker bar 44 to pivot rocket bar 44 and move wedged-shaped end 44*e* in extended position (FIG. 14). By this time, ground yarn GY is supplied from yarn carrier 28 and crosses over top edge 27*i* of sinker 27 and is fed to the knitting needle 22.

As rocker bar 44 moves with rotating sinker cap 25, wedge-shaped end 44*e* engages the protrusion 48*b* of cam 48 and rocker bar 44 and rocker bar supporting member 40 are pushed inwardly toward the cylinder 21. Rocker bar supporting member 40 engages and pushes inwardly intermediate member 34 such that butt 34*a* engages the inwardly slanting section $37a_1$ of side edge 37*a* of second intermediate cam 37 which pushes intermediate member 34 even further inwardly toward cylinder 21.

Intermediate member 34 engages sinker 27 and advances sinker 27 to its most extended inward position in which nose 27*g* is in position to receive pile yarn PY from yarn carrier 28 across the top edge 27*h* thereof to form a pile loop in concert with needle 22. When butt 34*a* reaches the straight section $37a_2$ of side edge 37*a* of second intermediate cam 37, the tip of nose 27*g* of sinker 27 is preferably at least 0.3 mm inward from the circumferential action line L (FIG. 7) of the knitting needle 22. Therefore, formation of a pile loop at least 0.3 mm from the tip of nose 27*g* is ensured and will prevent such pile loop from prematurely slipping off of top edge 27*h* of sinker 27.

While intermediate member 34 is being pushed further out by second intermediate cam 37, butt 41*a* on rocker bar supporting member 40 engages the outwardly slanting portion of concave section 35*c* of first intermediate cam 35 which returns rocker bar supporting member 40 and thus rocker bar 44 to their original retracted positions. Of course, it is possible to omit intermediate member 34 and have rocker bar supporting member 40 act directly on sinker 27. Suitable modification of the cam system would also be required.

When sinker 27 is not to be advanced, a signal is sent to electromagnet 54 so as to attract magnetically attractable section 44*f* of rocker bar 44 to pivot rocker bar 44 to extend wedge-shaped end 44*d*. Rocker bar 44 does not engage rocker bar actuating cam 48 and, therefore, rocker bar 44 and rocker bar supporting member 40 do not move inwardly in groove 26 of sinker cap 25. Consequently, intermediate member 34 is not pushed inwardly and butt 34*a* thereon remains in branch 36*b* of cam track 36. Sinker 27 is thus only controlled by cam track 33 and both the pile yarn and ground yarn GY are fed to needle 22 and form ground stitch loops across the second top edge 27*i* of sinker 27. The action line $L_2$ (FIG. 7) shows the action of sinker 27 forming pile and nonpile loops in the knitted fabric.

As each rocker bar 44 approaches the electronic attracting device 50, the rocker bar 44 is preferably aligned to be horizontal by the cancelling cam 49. The rocker bar 44 is thus always in the is neutral position when it reaches the magnetic selecting device 50, 50' or 50".

Figure 15A:
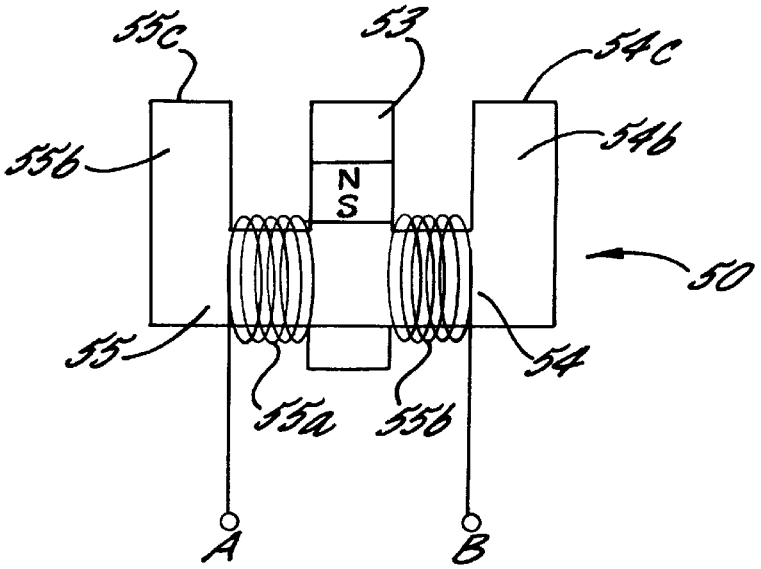
FIG. 15A is a schematic view of a still further embodiment of the electromagnetic selecting mechanism of the present invention with wiring for the selection of even numbered knitting elements.
Figure 15B:
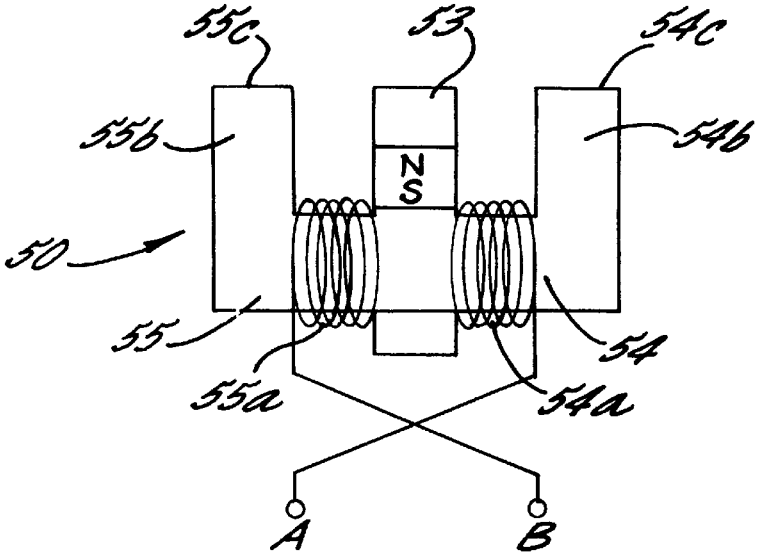
FIG. 15B is a view similar to FIG. 15A with wiring for the selection of odd numbered knitting elements.

In the electromagnetic selecting device 50, 50' and 50", the North pole and the South pole of the permanent magnet 53 are arranged outward and inward respectively. When this electromagnetic selecting device 50, 50', or 50" is employed as a sinker control in a circular knitting machine, alternating the poles between mutually adjacent yarn feeders eliminates residual magnetism in the rocker bar 44. In this manner, if a positive voltage applied to electromagnets 54 and 55 (FIG. 15A) at one yarn feeder is alternated with a negative voltage applied to the electromagnets 54, 55 at the next yarn feeder (FIG. 15B), control signals for other action or nonaction from the control apparatus can have the same polarity for every yarn feeder.

As described above, by using the sinker control mechanism of the present invention, it is possible to select "pile" or "non-pile" in accordance with the pattern signal output from the controller and knit a jacquard pile fabric with a profiled surface. The application of the present invention, however, is not restricted to knitting machines for manufacturing jacquard pile fabrics. The present invention contemplates application of the jacquard selection mechanism to a wide variety of knitting machines in which knitting elements, such as sinkers, cylinder needles, dial needles and jacquards, to name just a few, are selectively controlled in at least two different paths.

The electronic magnetic selection device of the present invention minimizes needle selection errors by minimizing the influence from the previous or subsequent signals to the electronic selection device 50, 50' or 50". Previously, when a rocker bar 44 and its associated electromagnetic selection means 51 and 52 receive a first signal at a needle selection point, this first rocker bar 44 moves for a certain distance in the rotational direction of the knitting machine before a subsequent signal is sent to the electromagnetic selecting device 50 or 50' for the next rocker bar 44. When the subsequent signal is sent to the electromagnetic selecting device 50 or 50' is of opposite polarity from the immediately preceding signal, the potential for the second signal being influenced by the first signal was present. In general, the length of the moving distance of the previous rocker bar, i.e. the longer the pitch between the rocker bars, and the lower the needle-selection current to the electromagnetic selection device 50, the less influence from the previous or subsequent signals occurs and, therefore, a more stable needle selection is achieved.

Tests have been conducted which have measured the moving distance required for stable needle selection. The performance test results of the control mechanism of the present invention are shown below in Table 1, whereas the performance test results of the control mechanism of U.S. Pat. No. 5,689,977 are shown in Table 2.

TABLE 1

PERFORMANCE TEST ON THE ELECTROMAGNETIC SELECTING APPARATUS OF THE PRESENT INVENTION

| TRAVEL OF THE ROCKER BAR (mm) | | | | | | | | |
|---|---|---|---|---|---|---|---|---|
| 1.1 | X | ○ | ○ | ○ | ○ | ○ | ○ | ○ |

TABLE 1-continued

PERFORMANCE TEST ON THE ELECTROMAGNETIC SELECTING APPARATUS OF THE PRESENT INVENTION

| | | | | | | | | |
|---|---|---|---|---|---|---|---|---|
| 1.0 | X | ○ | ○ | ○ | ○ | ○ | ○ | ○ |
| 0.9 | X | ○ | ○ | ○ | ○ | ○ | ○ | ○ |
| 0.8 | X | ○ | ○ | ○ | ○ | ○ | ○ | ○ |
| 0.7 | X | ○ | ○ | ○ | ○ | ○ | ○ | ○ |
| 0.6 | X | ○ | ○ | ○ | ○ | ○ | ○ | ○ |
| 0.5 | X | ○ | ○ | ○ | ○ | ○ | ○ | ○ |
| 0.4 | X | ○ | ○ | ○ | ○ | ○ | ○ | ○ |
| 0.3 | X | ○ | ○ | ○ | ○ | ○ | ○ | ○ |
| 0.2 | X | ○ | ○ | ○ | ○ | ○ | ○ | ○ |
| 0.1 | X | ○ | ○ | ○ | ○ | ○ | X | X |
| | 0.10 | 0.15 | 0.20 | 0.25 | 0.30 | 0.35 | 0.40 | 0.45 |

OUTPUT CURRENT (A) TO THE ACTUATOR

TABLE 2

PERFORMANCE TEST ON THE ELECTROMAGNETIC SELECTING APPARATUS OF U.S. PAT. NO. 5,689,977

| TRAVEL OF THE ROCKER BAR (mm) | | | | | | | | |
|---|---|---|---|---|---|---|---|---|
| 1.1 | X | X | ○ | ○ | ○ | ○ | ○ | ○ |
| 1.0 | X | X | ○ | ○ | ○ | ○ | ○ | ○ |
| 0.9 | X | X | ○ | ○ | ○ | ○ | ○ | ○ |
| 0.8 | X | X | ○ | ○ | ○ | ○ | ○ | ○ |
| 0.7 | X | X | X | X | X | X | X | X |
| 0.6 | X | X | X | X | X | X | X | X |
| 0.5 | X | X | X | X | X | X | X | X |
| 0.4 | X | X | X | X | X | X | X | X |
| 0.3 | X | X | X | X | X | X | X | X |
| 0.2 | X | X | X | X | X | X | X | X |
| 0.1 | X | X | X | X | X | X | X | X |
| | 0.10 | 0.15 | 0.20 | 0.25 | 0.30 | 0.35 | 0.40 | 0.45 |

OUTPUT CURRENT (A) TO THE ACTUATOR

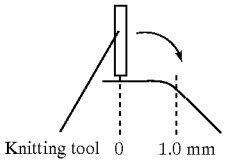

Attractable part cross section.

○: Normal
X: Error

It is evident from Table 2 that heretofore a minimum pitch between rocker bars was 0.8 mm before stable needle selection was achieved. With the present invention, a pitch of only 0.4 mm is necessary to obtain stable needle selection as is shown in Table 1. Accordingly, fine gauge, high speed operation with a short rocker-bar-to-rocker-bar pitch is possible (e.g., a minimum of 32 needles per inch with a pitch distance of 0.79 mm or less).

The chart contained in Table 3 below illustrates test results where the performance of the electromagnetic selecting mechanism 50 are shown. In this chart, the X axis represents current values while the Y axis represents the attraction between the tips 54*c*, 55*c* of the cores 54, 55 and the attractable sections 44*f* and 44*g* of the rocker bar 44. Model 1 represents a gap distance between the tips of 54*c* and 55*c* and the attractable sections 44*f* and 44*g* to be 1.0 mm with a single permanent magnet 53 associated therewith. Model 2 shows a gap of 1.0 mm with two permanent magnets 70 and 71 associated with the cores 54*b*', 55*b*' of the electromagnets 54' and 55', while Model 3 employs a gap of 5.0 mm and one permanent magnet 53. As shown in this chart, Model 3 has the weakest attraction while Model 1 has a stronger attraction than Model 3. However, Model 2 has the strongest attraction of all.

TABLE 3

MEASUREMENT OF ATTRACTION OF THE ACTUATOR

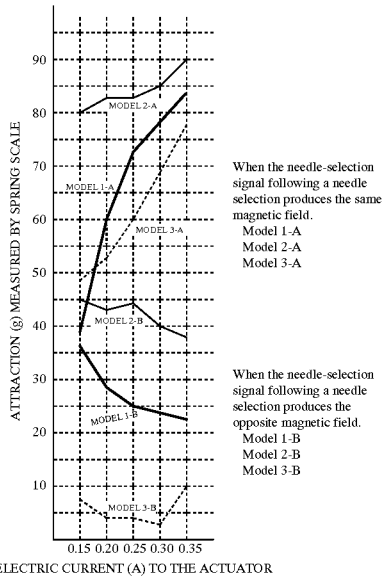

Model 1: L2 = 1.0 mm
Model 2: L2 = 1.0 mm (Magnetic attraction of the permanent magnet doubled)
Model 3: Conventional (L1 = 5.0 mm)

The electromagnetic selecting mechanism 50, 50' or 50" of the present invention when, used in a jacquard circular knitting machine, occupies considerable less space within the knitting machine. Further, because the electromagnetic selecting mechanism of the present invention has a strong magnetic field, needle selection errors are minimized. A further advantage of the present invention is that the rocker bar 44 does not employ a projecting butt, but instead the end portions 44*d* and 44*e* of the rocker bar 44 engage directly against the rocker bar raising cam 48. Therefore, the rocker bar 44 does not slip off of the rocker bar raising cam 48 and this eliminates selection errors. In addition, the danger of butt breakage is minimal or nonexistent. Finally, because the rocker bar 44 is the only item to be controlled, the magnetic attracting means 51 and 52 may also be made compact. The electronic magnetic selecting device 50, 50' or 50" can be computer controlled and, therefore, fabrics of a wide variety of patterns can be produced.

In the drawings and specifications, there has been set forth a preferred embodiment of the invention, and although specific terms are employed, they are used in a generic and descriptive sense only and not for purposes of limitation, the scope of the invention being set forth in the following claims.

That which is claimed:

1. In a circular knitting machine having knitting instrumentalities for forming knit fabric including a rotating member having a plurality of grooves in which said knitting instrumentalities are slidably mounted, the improvement comprising control means for controlling said knitting instrumentalities to produce jacquard knit fabric, said control means comprising a plurality of rocker bar supporting members each slidably mounted in one of the grooves along with one of said knitting instrumentalities, each of said plurality of rocker bar supporting members including at least one butt protruding therefrom, a plurality of elongate rocker bars formed free of butts and having magnetically attractable opposite end portions and each being pivotally mounted on one of said plurality of rocker bar supporting members for movement about a medial pivot, the opposite end portions of said elongate rocker bar being selectively movable between operative and inoperative positions, magnetic attracting means operatively associated with the opposite end portions of said elongate rocker bars for selectively attracting one of said magnetically attractable opposite end portions to pivot said elongate rocker bars and selectively move one of the opposite end portions to said operative position and the other of the opposite end portions to said inoperative position, said magnetic attracting means comprising a permanent magnetic and a pair of electromagnets disposed on opposite sides of said permanent magnet and connected in series, said permanent magnet having an extension extending outwardly toward said rocker bars and having a pair of wing portions generally parallel to said rocker bar supporting members and having outer sections disposed in attractable relation to said magnetically attractable end portions of said rocker bars, rocker bar operating cam means engageable with the end portion of said rocker bar in said operative position for either moving the rocker bar and the rocker bar supporting member assembly from a retracted position to an extended position for engagement and movement said knitting instrumentality or maintaining the rocker bar an the rocker bar supporting member assembly in said retracted position, and control cam means engageable with said knitting instrumentalities for controlling said knitting instrumentalities and for moving the instrumentalities to at least one knitting position upon movement of the rocker bar supporting member to the extended position and for maintaining said knitting instrumentality in a nonknitting position when the rocker bar supporting member is in the retracted position.

2. A circular knitting machine according to claim 1 wherein said wing portions of said extension of said permanent magnet are slanted upwardly and outwardly to accommodate pivotal movement of said rocker bars without being touched thereby.

3. A circular knitting machine according to claim 2 wherein said magnetically attractable end portions of said rocker bars slant downwardly and outwardly substantially to the same degree as the slant on said wing portions of said extension of said permanent magnet.

4. A circular knitting machine according to claim 3 wherein each of said electromagnets comprises a core and a coil surrounding a portion of said core, said cores having tips disposed in magnetic attractable relation to said magnetically attractable end portions of said rocker bars and being slanted upwardly and outwardly substantially as the slant on said wing portions of said extension of said permanent magnet, whereby upon pivotal movement of said rocker bar a gap is maintained between said magnetically attractable end portions of said rocker bars and said wing portions and said core tips.

5. A circular knitting machine according to claim 4 wherein said gaps have a width of between about 0.5 mm and about 2.0 mm.

6. A circular knitting machine according to claim 1 wherein said electromagnets comprise cores and coils wound about portions of said cores, said cores having core tips disposed in magnetic attractable relation to said attractable end portions of said rocker bars.

7. A circular knitting machine according to claim 6 including an additional permanent magnet disposed in operative association with each of said core tips of said electromagnets.

8. A circular knitting machine according to claim 6 wherein said core tips are in spaced relation to and in alignment with said wing portions of said extension of said permanent magnet and including second and third permanent magnets mounted between said wing portions of said extension of said permanent magnet and said core tips of said electromagnets.

9. A circular knitting machine according to claim 8 wherein said second and third permanent magnets bridge the spaces between said wing portions and said core tips.

10. A circular knitting machine according to claim 9 wherein upper surfaces of said wing portions, said second and third permanent magnets and said core tips are in a straight line.

11. A pattern control mechanism for a circular knitting machine having knitting instrumentalities slidably mounted in grooves in at least one rotatable member, said pattern control mechanism comprising a plurality of rocker bar supporting members slidably mounted in the grooves of the rotating member with the knitting instrumentalities and each of the support members has at least one operating butt thereon, an elongate rocker bar having magnetically attractable sections at opposite end portions thereof, the rocker bar being buttless said elongate rocker bar being pivotally mounted on each of said plurality of rocker bar supporting member for movement about a medial pivot thereon, rocker bar operating cam means for moving the rocker bar and rocker bar supporting member assemblies longitudinally upon engagement with one end of said elongate rocker bar and for maintaining said elongate rocker bar in a retracted position upon engagement with the other end thereof, and magnetic attracting means operatively associated with said magnetically attractable sections at opposite end portions of said elongate rocker bar for attracting selectively the magnetically attractable sections to control the knitting instrumentalities in a predetermined pattern, said magnet attracting means comprising a permanent magnet and a pair of electromagnets disposed on opposite sides of said permanent magnet and connected in series, said permanent magnet having an extension extending outwardly toward the rocker bars and having a pair of wing portions of a length sufficient to overlap portions of the magnetically attractable sections of the rocker bars.

12. A pattern control mechanism according to claim 11 wherein said extension of said permanent magnet is of magnetic material.

13. A pattern control mechanism according to claim 12 wherein said extension is of permanent magnetic material.

* * * * *

UNITED STATES PATENT AND TRADEMARK OFFICE

CERTIFICATE OF CORRECTION

PATENT NO. : 5,983,677

DATED : November 16, 1999

INVENTOR(S) : Shibata

It is certified that error appears in the above-indentified patent and that said Letters Patent is hereby corrected as shown below:

Title page, item [30], under Foreign Application Priority Data, insert--
April 1, 1997 Japan 9-99638--

Signed and Sealed this

Twentieth Day of March, 2001

Nicholas P. Godici

*Attest:*

NICHOLAS P. GODICI

*Attesting Officer*

*Acting Director of the United States Patent and Trademark Office*